United States Patent [19]

Kawano et al.

[11] 4,244,305

[45] Jan. 13, 1981

[54] FLUIDIZED BED INCINERATOR

[75] Inventors: Akio Kawano; Isao Tanaka, both of Kumagaya, Japan

[73] Assignee: Riken Piston Ring Kogyo Kabushiki Kaisha, Tokyo, Japan

[21] Appl. No.: 38,695

[22] Filed: May 14, 1979

[30] Foreign Application Priority Data

May 12, 1978 [JP] Japan ..... 53/63430[U]

[51] Int. Cl.[3] ..... F23G 5/00; F23G 7/00; F23C 11/02

[52] U.S. Cl. ..... 110/245; 431/7; 431/170; 110/255

[58] Field of Search ..... 110/235, 243–248, 110/251, 255, 346, 257, 263, 347; 431/7, 170; 122/4 D; 432/58

[56] References Cited

U.S. PATENT DOCUMENTS

| | | | |
|---|---|---|---|
| 3,605,656 | 9/1971 | Stribling | 110/247 |
| 3,772,998 | 11/1973 | Menigat | 110/245 X |
| 3,922,975 | 12/1975 | Reese | 110/245 X |
| 4,168,670 | 9/1979 | Wall et al. | 110/346 |
| 4,171,945 | 10/1979 | Lazenby | 431/170 |

*Primary Examiner*—John Petrakes

*Attorney, Agent, or Firm*—Finnegan, Henderson, Farabow, Garrett & Dunner

[57] ABSTRACT

An incinerator including a first combustion chamber having a rotatable hearth for initially drying and partially burning waste materials and a second combustion chamber comprising a fluidized bed furnace for receiving the partially burnt materials from the first chamber and completing the burning thereof.

7 Claims, 1 Drawing Figure

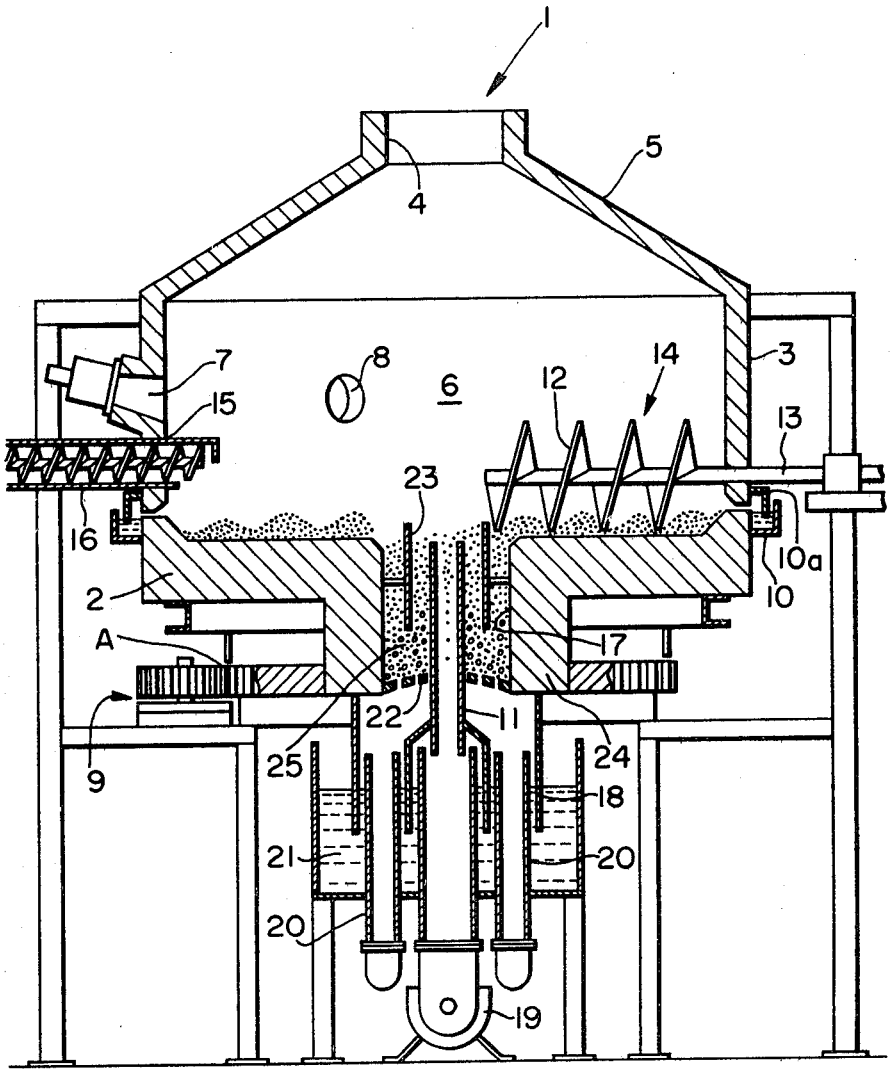
1
5
4
7
8
6
12
14
3
15
13
23
16
10a
2
10
A
17
22
11
9
25
24
18
21
20
20
19

FLUIDIZED BED INCINERATOR

The present invention relates to a fluidized bed incinerator and more particularly to an incinerator for burning waste material having a rotatable hearth for initially drying and partially burning the waste materials and a fluidized bed furnace for receiving the partially burnt waste from the rotating hearth and completing the burning thereof.

BACKGROUND OF THE INVENTION

There have been provided in the past many different types of incinerators for burning waste materials resulting from municipal trash collections, business or industrial plant operations, sewage systems, and the like. The materials to be consumed are necessarily varied not only in shape and composition but also in moisture content. As a result such materials are not always completely consumed in existing incinerators causing smoke and generation of clinkers or unburnt cakes of waste material which are impossible to reburn and must be otherwise gotten rid of.

An example of a prior art incinerator is shown in U.S. Pat. No. 3,605,656 to J. B. Stribling in which waste materials are fed by a conveyor onto a rotatable hearth in a combustion chamber and burnt during displacement from a peripheral portion of the hearth toward the center, the burnt material passing out through an ash outlet in the center of the hearth. During the displacement of the waste materials on the hearth, deflectors are provided for agitating the waste materials in an effort to increase the drying of the material, maximize combustion and reduce the formation of clinkers. Nevertheless, it has been found that the burning operation is not always complete in such a incinerator due to the wide variation in the nature and character of the waste materials supplied to the furnace.

Examplary of another type of furnace is shown in U.S. Pat. No. 3,772,998 having a multi-stage dryer for first drying waste material and a fluidized bed furnace for receiving the materials from the dryer and burning it under forced air and at high temperatures. The use of the dryer more satisfactorily drys the waste material permitting more complete combustion in the fluidized bed furnace, but the equipment is expensive to manufacture, is complicated in construction and costly to operate.

SUMMARY OF THE INVENTION

An object of the present invention therefore is to provide a new and improved and more efficient incinerator having a fluidized bed furnace for burning any kind of waste material from town refuge, waste products of plants or any other types of places.

Yet another object of the present invention is to provide such an incinerator in combination with a first combustion chamber having a rotating hearth for initially drying and partially burning the waste materials before burning them in a fluidized bed furnace in order to ensure more complete combustion of the materials.

To achieve the foregoing objects and in accordance with its purpose, the fluidized bed incinerator of the present invention comprises shield wall means defining therein a first cylindrical combustion chamber, means for drying and burning waste materials in the chamber under forced air and at high temperature, an annular rotatable hearth rotatable about a vertical axis in the combustion chamber and defining the bottom thereof, means for rotating the hearth, an opening in said wall means and conveyer means for charging waste materials through said opening onto the periphery of said hearth, said hearth having a downwardly extending outlet in the center thereof, means disposed above the hearth for moving the waste materials from the periphery to the center of the hearth and for breaking up and agitating the materials to ensure contact with the hot air and high temperatures in the first combustion chamber and effect a drying and partial burning thereof, a second combustion chamber for completing the burning thereof comprising a fluidized bed furnace connected to the outlet in the hearth for receiving the dried and partially burnt material as it falls through the outlet, said furnace having a perforated plate located in the lower portion of the second combustion chamber, means for forcing air upwardly through the plate into said second combustion chamber to maintain the materials in a fluidized and burning state, and an ash outlet extending upwardly through the plate and the center of the second combustion chamber and having an upper inlet end in the chamber for receiving ash from the second combustion chamber and a lower outlet end for discharging the ash from the incinerator.

DETAILED DESCRIPTION

The accompanying drawing which is incorporated in and constitutes a part of this specification, illustrates one embodiment of the invention and together with a description serves to explain the principles of the invention.

The drawing is a vertical sectional view of an incinerator constructed in accordance with the present invention having a rotatable hearth and a fluidized bed furnace.

With reference to the drawing, there is shown an incinerator (1) having shield wall means defining a first cylindrical combustion chamber 6 and an annular rotatable hearth 2 constituting the bottom of the chamber. As embodied the shield wall means is constructed of conventional fire brick and consists of a cylindrical and vertically disposed wall portion 3 and a conical wall portion 5 leading to a smoke flue 4.

Tangential combustion air inlets 8 and fuel burners 7 are provided in wall portion 3 above hearth 2 and are operated in combination with a blower and fuel supply not shown to direct a tangential flow of air and flame into combustion chamber 6 in a conventional manner.

An opening 15 is provided in wall 3 through which a conveyer means 16 passes for feeding or charging waste materials to combustion chamber 6 and more particularly to the periphery of hearth 2. Rotatable hearth 2 has a cylindrical outlet 17 which extends downwardly from the center of the hearth and defines a second combustion chamber 25 as more fully described below. Means such as a gear 9 operated and controlled by a suitable motor (not shown) and cooperating with a gear A on a downwardly extending wall portion 24 of rotatable hearth 2 is provided for turning the hearth at a predetermined speed of rotation.

Rotatable means 14 located above the hearth 2 are further provided to move the material from the periphery toward the cylindrical outlet 17 in the center of the hearth and to agitate and break up the waste materials to ensure contact with the hot air and the high temepratures in the chamber. Rotatable means 14 as embodied comprises a spiral shaped plow 12 mounted on a shaft 13 that extends through cylindrical wall 3 and is rotated by any suitable means not shown.

The waste materials are dryed and partially burned during rotation of the hearth and then moved by spiral plow 12 toward central outlet 17 in the center of the hearth. This tends to eliminate the generation of clinkers and facilitates the drying of any kind of wet material that may be fed to the incinerator. The partially burned waste materials then fall down through central outlet 17 and into a second combustion chamber 25 defined by the downwardly extending wall portion 24 of the hearth.

A perforated plate 22 is located at the bottom of second combustion chamber 25 through which hot air is forced to form a fluidized bed furnace in chamber 25. A cylindrical skirt 18 extends downwardly from the bottom of wall portion 24 into a water bath 21 to provide a water-seal arrangement between the atmosphere and the internal chambers of the incinerator.

A further water-seal arrangement is also provided between wall portion 3 and rotatable hearth 2 which includes skirt 10A extending down into an annular channel 10 filled with water.

In accordance with the invention, means are provided for forcing air upwardly through plate 22 and into chamber 25 as shown, this means comprises a pair of pipes 20 extending upwardly through water bath 21 and into the area surrounded by skirt 18 to supply a second air flow up through second combustion chamber 25, the air eventually passing upwardly into first combustion chamber 6 and out flue 4. Suitable blowers not shown and connected to pipes 20 may be used to provide the required flow of air.

An ash outlet duct 11 is arranged in the interior of chamber 25 and passes downwardly through water-seal bath 21 having an upper inlet opening near the top of chamber 25 for receiving ash from the fluidized bed furnace and for discharging the ash into a conveyer 19 located at the bottom of the incinerator.

Stationary baffle or deflector 23 is further arranged in second combustion chamber 25 to break up any unburnt materials or to prevent them from being directly supplied into the duct 11 as they pass downwardly from hearth 2 through outlet 17 and into chamber 25 to ensure more complete combustion in the fluidized bed furnace.

As is apparent from the above description, the waste materials charged onto the periphery of the rotating hearth by conveyer 16 are turned in first chamber 6 and transferred from the peripheral portion of the hearth to the center portion while being agitated and broken up by plow 12 to facilitate their drying and to cause partial burning thereof. The dried materials on the hearth then fall immediately down into fluidized bed chamber 25 where they are fluidized by the flow of hot air from pipes 20 passing up through the holes in plates 22, the air mixing with the tangential flow of air from air inlet 8 so as to further increase the efficiency of the drying and the partial burning of the waste materials on the hearth and to eliminate the discharge of floating solid materials through flue. In chamber 25 the materials are subjected to complete combustion under the fluidized conditions created therein by the flow of air through the chamber.

In the illustrated embodiment the fluidized furnace is defined by the downwardly directed cylindrical wall portion 24 that is integral with and turns with the rotating hearth to provide for efficient transfer of the waste materials from the hearth into the fluidized chamber. However, it is to be understood that the fluidized furnace can be stationary with just the hearth turning and with a suitable connection between them without departing from the scope of the invention. In either event, ash is collected by a central duct 11 passing downwardly from the fluidized bed furnace and onto a conveyer 19.

What is claimed is:

1. A fluidized bed incinerator for waste material comprising shield wall means defining therein a first cylindrical combustion chamber, means for drying and burning waste materials in the chamber under forced air and at high temperatures, an annular rotatable hearth rotatable about a vertical axis in the combustion chamber and defining the bottom thereof, means for rotating the hearth, an opening in said wall means and conveyer means for charging waste materials through said opening onto the periphery of said hearth, said hearth having a downwardly extending outlet in the center thereof, means disposed above the hearth for moving the waste materials from the periphery to the center of the hearth and for breaking up and agitating the material to ensure contact with the hot air and high temperatures in the first combustion chamber and effect a drying and partial burning thereof, a second combustion chamber for completing the burning thereof comprising a fluidized bed furnace connected to the outlet in the hearth for receiving the dried and partially burnt material as it falls through the outlet, said furnace having a perforated plate located in the lower portion of the second combustion chamber, means for forcing air upwardly through the plate into said second combustion chamber to maintain the materials in a fluidized and burning state, and an ash outlet extending upwardly through the plate and the center of the second combustion chamber and having an upper inlet end in the chamber for receiving ash from the second combustion chamber and a lower outlet end for discharging the ash from the incinerator.

2. The incinerator of claim 1 in which the shield wall means is made of firebrick and comprises a cylindrical vertical wall portion and a conical wall portion leading to a smoke flue in the top thereof.

3. The incinerator of claim 2 including sealing means between the vertical wall portion of the first combustion chamber and the rotatable hearth to seal the interior of the chamber.

4. The incinerator of claim 1 in which the means for transferring and agitating the waste material comprises a spiral shaped plow rotatable on a horizontal axis above the hearth and means for rotating said plow.

5. The incinerator of claim 1 in which the means for drying and burning the waste in the first combustion chamber comprises at least one fuel burner firing into said chamber above the hearth and a blower for circulating a tangential flow of air around the interior of the cylindrical chamber.

6. The incinerator of claim 1 including deflectors mounted near the upper end of the second combustion chamber for breaking up the dried and partially burnt waste material and prevent direct discharge thereof into the ash outlet as it falls from the hearth into the fluidized bed furnace.

7. The incinerator of claim 1 in which the outlet of the hearth has downwardly extending walls integral therewith and defining the second combustion chamber, said perforated plate being located across the bottom of the chamber wherein the second combustion chamber rotates with said hearth.

* * * * *